US006580796B1

(12) United States Patent
Kuroki

(10) Patent No.: US 6,580,796 B1
(45) Date of Patent: Jun. 17, 2003

(54) SOUND EFFECT IMPARTING APPARATUS

(75) Inventor: Ryuichiro Kuroki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/238,646

(22) Filed: Jan. 26, 1999

(30) Foreign Application Priority Data

Jan. 27, 1998 (JP) ..... 10-014646

(51) Int. Cl.[7] ..... G10K 15/12

(52) U.S. Cl. ..... 381/63; 381/61; 84/630; 84/707; 84/DIG. 26

(58) Field of Search ..... 381/63, 61; 84/630

(56) References Cited

U.S. PATENT DOCUMENTS

| | | | | |
|---|---|---|---|---|
| 3,992,582 A | * | 11/1976 | Osakabe | 381/63 |
| 4,475,229 A | | 10/1984 | Frese | 381/63 |
| 4,584,701 A | * | 4/1986 | Nakama et al. | 381/63 |
| 4,984,276 A | | 1/1991 | Smith | 381/63 |
| 5,182,415 A | * | 1/1993 | Kunimoto | 84/660 |
| 5,223,653 A | * | 6/1993 | Kunimoto et al. | 84/624 |
| 5,382,751 A | * | 1/1995 | Kitayama et al. | 84/661 |
| 5,491,754 A | * | 2/1996 | Jot et al. | 381/63 |
| 5,530,762 A | * | 6/1996 | Jones et al. | 381/63 |
| 5,621,801 A | | 4/1997 | Kunimoto et al. | 381/63 |
| 5,729,613 A | * | 3/1998 | Poletti | 381/63 |
| 5,748,513 A | * | 5/1998 | Van Duyne | 708/320 |

FOREIGN PATENT DOCUMENTS

| | | | |
|---|---|---|---|
| JP | 7-129165 | 5/1995 | G10H/1/02 |

* cited by examiner

*Primary Examiner*—Forester W. Isen
*Assistant Examiner*—Tony M. Jacobson
(74) *Attorney, Agent, or Firm*—Morrison & Foerster LLP

(57) ABSTRACT

Reverberation imparting functions as are obtained by a mechanical type reverberation apparatus employing coil spring delaying elements are simulated by an electric circuit configuration. Three delay loop circuits are individually provided, each including a first and a second delay circuit and delaying and circulating an input signal to thereby simulate the propagation of vibrations through each individual coil spring. Multiplier circuits are provided to individually supplying the out puts from the first and the second delay circuit in one delay loop circuit to the input sides of the second and the first delay circuit in two other delay loop circuits after controlling the signal characteristic to thereby simulate the propagation of vibrations through the supporting plates for the coil springs. A combined signal supplying circuit is provided to combine the respective outputs from the first and the second delay circuits and supplying the combined signal to the respective delay loop circuits again after controlling the signal characteristic, thereby simulating the propagation characteristics between the springs and the outer box. The final output signal is fed back via a multiplier circuit and the combined signal supplying circuit to the respective delay loop circuits to thereby simulate the acoustic feed back to the coil springs.

9 Claims, 3 Drawing Sheets

IN
OUT
FL
DL
DL1
DL2
APF
G
SS
D1
D2
D3
D4
D5
D6
F6
40
50
60
70
80
90

SOUND EFFECT IMPARTING APPARATUS

BACKGROUND OF THE INVENTION

1. Field of the Invention

The present invention relates to a sound effect imparting apparatus, and more particularly to an electrically configured reverberation effect imparting apparatus for imparting a reverberation effect to inputted signals by conducting signal processing on the inputted signals such as musical tone signals externally supplied from a musical instrument.

2. Description of the Prior Art

There has conventionally been well-known in the art such an artificial reverberation device of a mechanical type as shown in FIG. 3, which comprises an inner box 11 suspended by a plurality of suspension springs 14 within an outer box 15, a pair of support plates 12*a* and 12*b* fixed on the inner box 11, a plurality of coil springs 13 bridged between the support plates 12*a* and 12*b*, electromagnetic transducers (not shown) each provided at one end of each coil spring 13 and pick-up elements (not shown) each provided at the other end of each coil spring 13, wherein inputted signals are applied to the electromagnetic elements to torsionally vibrate the respective coil springs 13 and to convert the vibrations of the coil springs 13 at the other ends to electrical signals by means of the pick-up elements, the converted electrical signals being combined to make a composite reverberation output. The reverberation effect imparted to the externally inputted signals such as musical instrument tone signals by means of this type of reverberation device shows still on-going popularity among some music enthusiasts.

On the other hand, there has also been known in the art such a sound effect imparting device as shown in the unexamined Japanese Patent Publication No. 7-129165, which comprises delay circuits, memories, arithmetic circuits, and various electric circuits arranged in combination to constitute a plurality of delay loop means including first delay means to which are supplied input signals and second delay means which delay the output from the first delay means and feed back the delayed output from the second delay means to the input side of the first delay means, input signal supplying means which supplies externally inputted signals to the input side of each first delay means in each of the plurality of delay loop means, and composite output means which combines the output signals from the respective first delay means in the plurality of delay loop means and outputs the combined output signals.

The above-exemplified conventional reverberation devices, however, have inherent drawbacks such that the former type is mechanically constructed and therefore is expensive in production costs and requires a relatively large space for installation, and further requires careful handling, and that the latter type is not capable of sufficiently simulating the reverberation effect realized by the former mechanical reverberation device. Therefore, there has long been a want of an apparatus which electrically realizes the reverberation effect obtained by the former mechanical type reverberation device among some of music enthusiasts.

SUMMARY OF THE INVENTION

It is, therefore, a primary object of the present invention to solve the above want and provide an acoustic effect imparting apparatus which can be constructed in a compact size, and in low manufacturing costs, and which can be easily handled, and electrically realizes the rich reverberation effects as would be obtained by the former mechanical reverberation device.

According to one aspect of the present invention, a first constructional feature resides in that a sound effect imparting apparatus is constructed by providing: a plurality of delay loops each including a first delay device which delays an inputted signal to output a first delayed output signal, a second delay device which is connected to the first delay device and delays the first delayed output signal to output a second delayed output signal and feeds back the second delayed signal to the input side of the first delay device; an input signal supplier which receives an external input signal externally inputted to the apparatus and supplies the external input signal to input sides of the respective first delay devices of the plurality of delay loops; a composite output device which combines the delayed output signals from the respective first delay devices of the plurality of delay loops and outputs a combined delayed output signal; a first delayed signal supplier which controls a signal characteristic of each of the second delayed signals outputted from each of the second delay devices independently from the other second delayed signals from other second delay devices and supplies the controlled signal to the input sides of the first delay devices of other delay loops than the delay loop to which each of the second delay devices belongs; and a second delayed signal supplier which controls a signal characteristic of each of the first delayed signals outputted from each of the first delay devices independently from the other first delayed signals from other first delay devices and supplies the controlled signal to the input sides of the second delay devices of other delay loops than the delay loop to which each of the first delay device belongs.

According to this aspect of the present invention with the above-mentioned first constructional feature, a plurality of delay loops simulate the propagation of vibration along a plurality of coil springs 13 in the mechanical reverberation apparatus as described above with respect to the prior art, and the first and the second delayed signal supplier simulate the propagation of vibration on the plurality of coil springs 13 from one of the coil springs 13 to other coil springs 13 via the supporting plates 12*a* and 12*b*. This can electrically imitate the propagation characteristic of vibration among a plurality of coil springs which takes place via the supporting plates 12*a* and 12*b* in the aforementioned mechanical reverberation apparatus, and therefore this can realize the reverberation effect which is close to that of such a mechanical reverberation apparatus in a low manufacturing cost and in a compact size, and in an easy-to-handle configuration.

According to another aspect of the present invention, a second constructional feature resides in that a sound effect imparting apparatus is constructed by providing: the like plurality of delay loops; the like input signal supplier; and the like composite output device all as mentioned above; and further comprises a combined signal supplier which combines the first delayed signals and the second delayed signals respectively from the first delay devices and the second delay devices in the plurality of delay loops and controls a signal characteristic of the combined signal to thereafter supply the controlled signal to the input sides of the first and the second delay devices of the plurality of delay loops.

According to this aspect of the present invention with the above-mentioned second constructional feature, a plurality of delay loops simulate the propagation of vibration along a plurality of coil springs 13 as in the case of above-mentioned first constructional feature, and the combined signal supplier simulates the propagation of vibration wherein the vibrations propagating along the plurality of coil springs 13 are transmitted from the coil springs 13 to the external box 15 via the supporting plates 12*a* and 12*b*, the inner box 11 and the plurality of suspension springs 14 and wherein thus transmitted vibrations on the external box 15 are transmitted from the external box 15 back to the plurality of coil springs 13 via the plurality of suspension springs 14, the inner box 11 and the supporting plates 12*a* and 12*b*. This can electrically imitate the propagation characteristic of vibration between the coil springs 13 and the external box 15 in the aforementioned mechanical reverberation apparatus, and therefore this can realize the reverberation effect which is close to that of such a mechanical reverberation apparatus in a low manufacturing cost and in a compact size, and in an easy-to-handle configuration.

According to a further aspect of the present invention, a third constructional feature resides in that a sound effect imparting apparatus is constructed by providing: the like plurality of delay loops; the like input signal supplier; and the like composite output device all as mentioned above; and further comprises an output signal supplier which controls a signal characteristic of said combined delayed output signal from said composite output device and thereafter supplies the controlled signal to the input sides of the respective first and second delay devices of said plurality of delay loops.

According to this aspect of the present invention with the above-mentioned third constructional feature, a plurality of delay loops simulate the propagation of vibration along a plurality of coil springs 13 as in the case of above-mentioned first constructional feature, and the output signal supplier simulates the propagation of vibration wherein the acoustic vibration resulting from the generated tone signals are transmitted from atmosphere to and through the outer box 15, the suspension springs 14, the inner box 11, the supporting plates 12*a* and 12*b* and the plurality of coil springs 13. This can electrically imitate the feedback characteristic of the acoustic vibration to the mechanical elements of the reverberation apparatus, and therefore this can realize the reverberation effect which is dose to that of such a mechanical reverberation apparatus in a low manufacturing cost and in a compact size, and in an easy-to-handle configuration.

BRIEF DESCRIPTION OF THE DRAWINGS

For a better understanding of the present invention, and to show how the same may be practiced and will work, reference will now be made, by way of example, to the accompanying drawings, in which.

DESCRIPTION OF THE PREFERRED EMBODIMENTS

Figure 1:
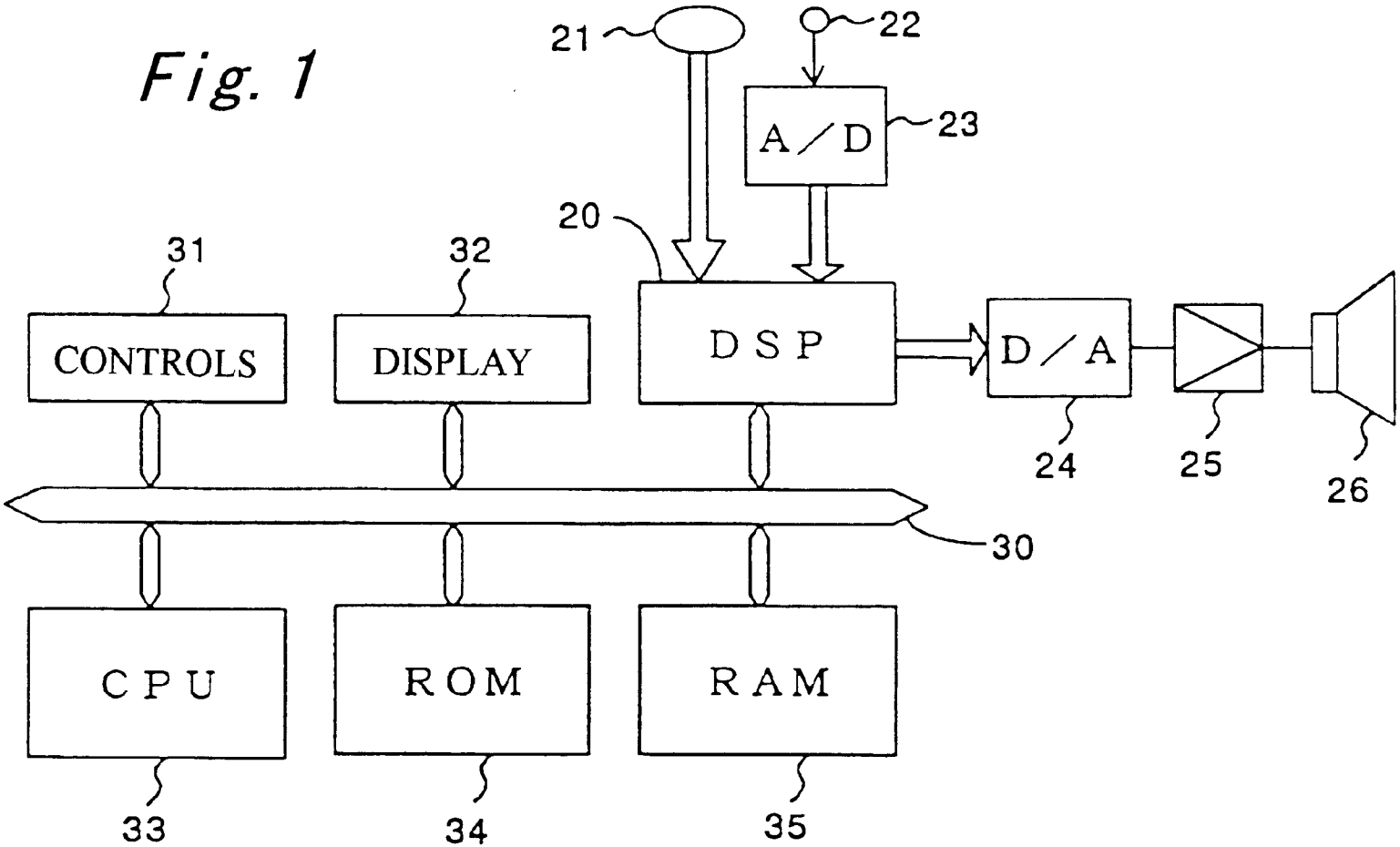
FIG. 1 is a block diagram showing an outline of an embodiment of a signal processing apparatus for realizing a sound effect imparting apparatus according to the present invention.

An embodiment of the present invention will be hereinafter described with reference to the accompanying drawings. Illustrated in FIG. 1 is a block diagram of a signal processing apparatus for realizing a sound effect imparting apparatus according to the present invention.

The signal processing apparatus is an apparatus which performs digital signal processing on musical instrument tone signals, voice signals and the like various digital signals to impart to such signals various sound effects such as a spring reverberation effect, a hall reverberation effect, and a delay effect, and comprises a digital signal processing circuit 20 including digital delay circuits, digital memories, digital arithmetic circuits and various other digital circuits and realizes various sound effect imparting circuits in accordance with the combination of those constituent circuits. To this digital signal processing circuit 20 are supplied external sound signals in a digital format representing musical instrument tones, voices, etc. via a digital input terminal 21 and also external sound signals in an analog format representing musical instrument tones, voices, etc. via an analog input terminal 22 and via an A/D converter 23 to be converted into digital format signals. The external sound signals in a digital format as processed by the digital signal processing circuit 20 is converted into analog signals by a D/A converter 24, amplified by the amplifier 25 and converted into acoustic signals by a loudspeaker 26 to be outputted into space.

The arrangement of the various electric circuits within the digital signal processing circuit 20 is set (determined) in accordance with the type of the sound effect such as a spring reverberation, a hall reverberation and a delay effect as selected by the controls 31 (including control knobs or switches and associated control circuits) connected to a bus 30. To the bus 30 is also connected a display 32 for displaying the type of the selected sound effect, and are further connected a CPU 33, a ROM 34 and a RAM 35 for controlling the selection of the sound effect and the arrangement of the various electric circuit within the digital signal processing circuit 20. The control of the arrangement of the various electric circuits within the digital signal processing circuit 20 includes the setting of the parameters for controlling the signal characteristic in the same processing circuit 20, wherein the CPU 33 conducts those various controls by executing programs stored in the ROM 34 and using the RAM 35. The ROM 34 stores the above-mentioned parameters, and a part of the RAM 35 may be used as a part of the memory for the digital signal processing circuit 20 in case the memory capacity provided within the digital signal processing circuit 20 should be insufficient for the signal processing.

Hereinbelow the structure of the digital signal processing circuit 20 will be described about the case where the spring reverberation effect is selected by the controls 31 in the above structured signal processing apparatus. The structure of the digital signal processing circuit 20 when the spring reverberation effect is selected (set) is shown by the block diagram of FIG. 2, wherein the digital signal processing circuit 20 comprises a first through third delay loop circuits 40, 50 and 60.

Figure 3:
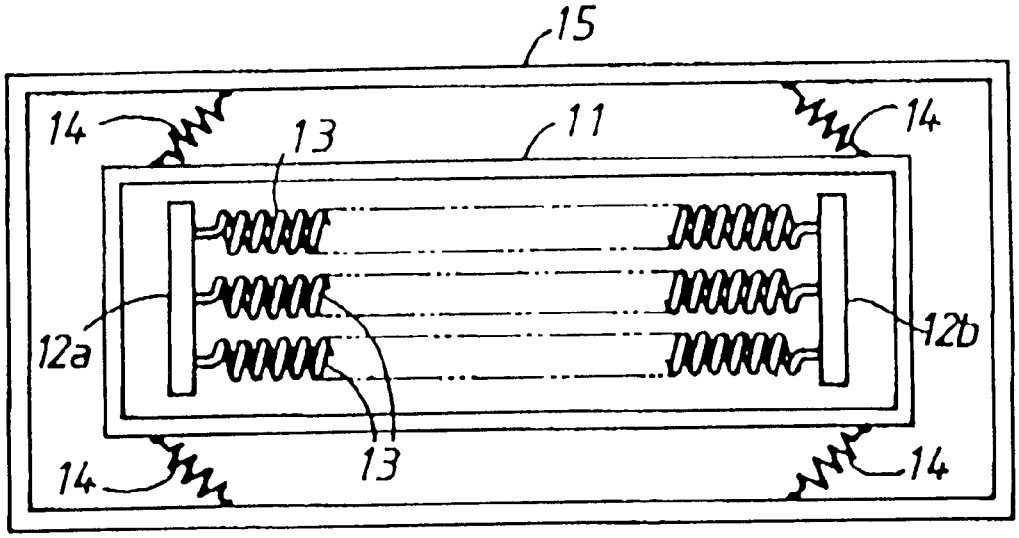
FIG. 3 is a schematic illustration of a conventional reverberation apparatus of a mechanical type.

The first delay loop circuit 40 is to simulate the propagation of vibration along a coil spring 13 in a mechanical reverberation apparatus of FIG. 3, and includes a first and a second delay circuit 41 and 42 each of which delays an inputted signal by a predetermined amount of delay time corresponding to the length of the coil sprig 13 and outputs the so delayed signal. The output end of the first delay circuit 41 is connected to the input end of the second delay circuit 42 via a multiplier 43, an adder 44 and a filter 45. The output end of the second delay circuit 42 is connected to the input end of the first delay circuit 41 via a multiplier 46, an adder 47 and a pair of allpass filter 48*a* and 48*b*. The multipliers 43 and 46 are to control the inputted signal by the predetermined gains and output the gain-controlled signals. The filter 45 is to control the frequency characteristic of the inputted signal and output the frequency-controlled signal, and is made of a lowpass filter, for example. The allpass filters 48*a* and 48*b* are to vary only the phase angle of the signal in accordance with the frequency while keeping the amplitude constant independent of the frequency, and to produce signals corresponding to a plurality of reflected sound waves. The output of the second delay circuit 42 is also outputted as a first delay-looped signal D1, while the output of the first delay circuit 41 is also outputted as a fourth delay-looped signal D4. The setting of the amplitude characteristic at the multipliers 43 and 46, the setting of the delay time at the delay circuit 41 and 42 and the setting of the filter characteristic at the filters 45,48*a* and 48*b* are controlled by the parameters supplied from the CPU 33 and ROM 34, but the description thereof is omitted here for the simplicity's sake.

The second delay loop circuit 50 is also constructed with a first and a second delay circuit 51 and 52, multipliers 53 and 56, adders 54 and 57, a filter 55 and a pair of allpass filters 58*a* and 58*b*, as in the case of the first delay loop circuit 40. And further, the output of the second delay circuit 52 is outputted as a second delay-looped signal D2, while the output of the first delay circuit 51 is outputted as a fifth delay-looped signal D5. The third delay loop circuit 60 is also constructed with a first and a second delay circuit 61 and 62, multipliers 63 and 66, adders 64 and 67, a filter 65 and a pair of allpass filters 68*a* and 68*b*, as in the case of the first delay loop circuit 40. And further, the output of the second delay circuit 62 is outputted as a third delay-looped signal D3, while the output of the first delay circuit 61 is outputted as a sixth delay-looped signal D6.

The first delay-looped signal D1 from the first delay loop circuit 40 is supplied to the adders 57 and 67 of the second and the third delay loop circuit 50 and 60 via multipliers 57*a* and 67*a*, while the fourth delay-looped signal D4 from the first delay loop circuit 40 is supplied to the adders 54 and 64 of the second and the third delay loop circuit 50 and 60 via multipliers 54*a* and 64*a*. The second delay-looped signal D2 from the second delay loop circuit 50 is supplied to the adders 47 and 67 of the first and the third delay loop circuit 40 and 60 via multipliers 47*a* and 67*b*, while the fifth delay-looped signal D5 from the second delay loop circuit 50 is supplied to the adders 44 and 64 of the first and the third delay loop circuit 40 and 60 via multipliers 44*a* and 64*b*. The third delay-looped signal D3 from the third delay loop circuit 60 is supplied to the adders 47 and 57 of the first and the second delay loop circuit 40 and 50 via multipliers 47*b* and 57*b*, while the sixth delay-looped signal D6 from the third delay loop circuit 60 is supplied to the adders 44 and 54 of the first and the second delay loop circuit 40 and 50 via multipliers 44*b* and 54*b*. The multipliers 47*a*, 47*b*, 57*a*, 57*b*, 67*a*, 67*b*, 44*a*, 44*b*, 54*a*, 54*b*, 64*a* and 64*b* respectively control the amplitude characteristic of the respective inputted signals independently and output such controlled signals individually.

To these first through third delay loop circuits 40, 50 and 60 are also connected an input signal supplying circuit 70 to supply an external input signal to the input points of the delay loop circuits 40,50 and 60, respectively, and also a composite output circuit 80 to combine the signals from the output points of the delay loop circuits 40, 50 and 60 and output the so-combined signal. The input signal supplying circuit 70 comprises an input terminal 71 for receiving an external input signal, a filter 72 connected to the input terminal 71, and multipliers 73, 74 and 75 respectively connected between the filter 72 and the respective adders 47, 57 and 67 of the first through third delay loop circuits 40, 50 and 60. The composite output circuit 80 comprises multipliers 81, 82 and 83 respectively connected to the respective connection points of the first delay circuit 41 and the multiplier 43 in the first delay loop circuit 40, of the first delay circuit 51 and the multiplier 53 in the second delay loop circuit 50 and of the first delay circuit 61 and the multiplier 63 in the third delay loop circuit 60, an adder 84 for adding the outputs from the respective multipliers 81, 82 and 83, a filter 85 connected to the output side of the adder 84, an adder 86 connected to the output side of the filter 85 and to the input terminal 71, and an output terminal 87 for outputting the added signal from the adder 86 to an external circuit. The filters 72 and 85 are to control the frequency characteristic of the inputted signal and to output the frequency-controlled signal, while the multipliers 73, 74, 75, 81, 82 and 83 are to individually control the amplitude characteristic of the inputted signal and to output the amplitude-controlled signal.

Figure 2:
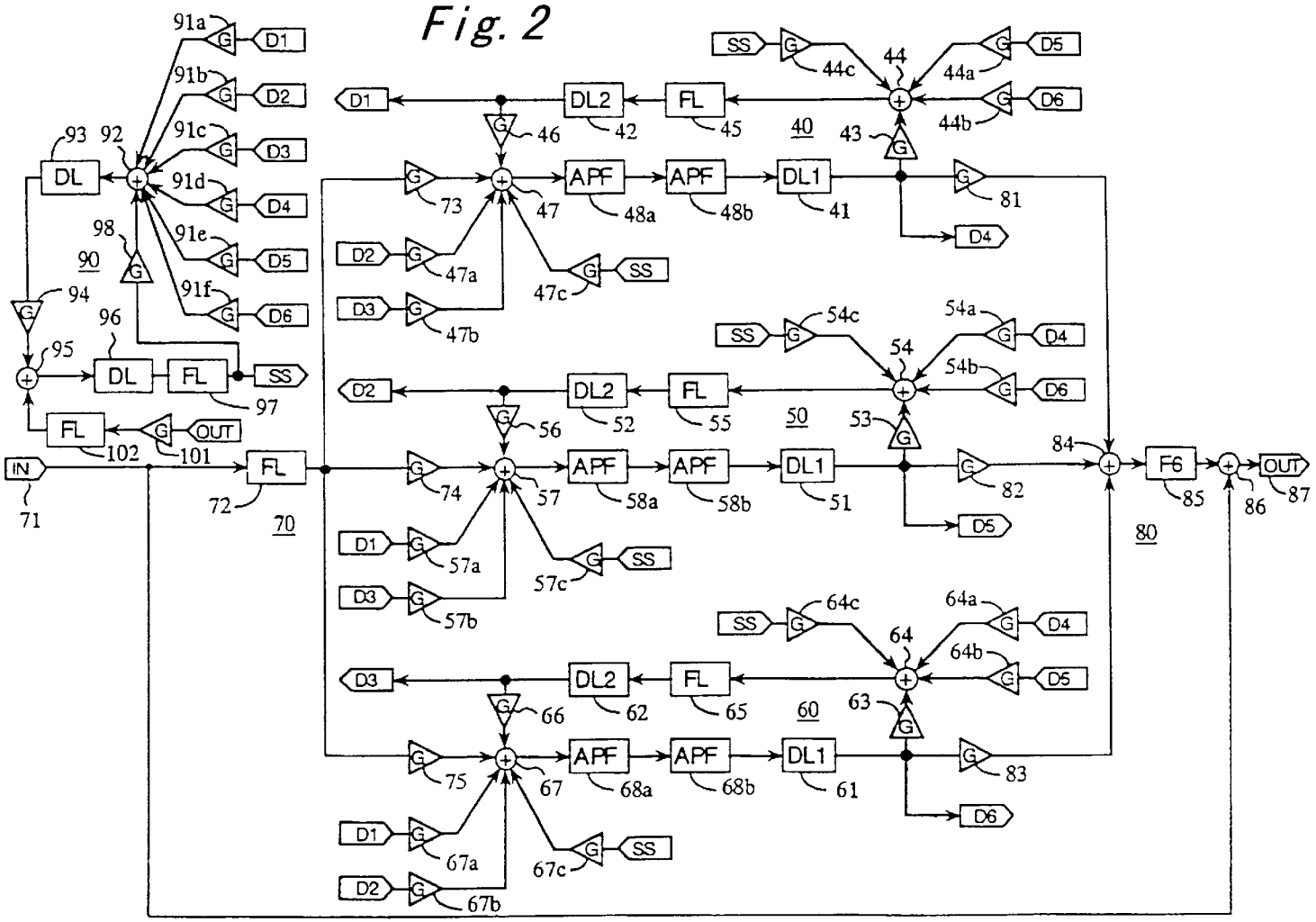
FIG. 2 is a block diagram showing a sound effect imparting circuit as realized in the form of a digital signal processing circuit according to the present invention.

The signal processing circuit in FIG. 2 further comprises a combined signal supplying circuit 90 which combines the first through sixth delay-looped signals D1–D6 from the first through third delay loop circuits 40, 50 and 60 and controls the characteristic of the combined signal before feeding back to the first through third delay loop circuits 40, 50 and 60. This combined signal supplying circuit 90 comprises multipliers 91*a*–91*f* for respectively controlling the amplitude characteristic of the first through sixth delay-looped signals D1–D6 and outputting the amplitude controlled signals, and an adder 92 for adding the first through sixth amplitude controlled delay-looped signals D1–D6 The output from the adder 92 is fed back to another input point of the adder 92 via a delay circuit 93, a multiplier 94, an adder 95, a delay circuit 96, a filter 97 and a multiplier 98. The delay circuits 93 and 96 are to simulate the vibration propagation characteristic between the inner box 11 and the outer box 15 via the suspension springs 14 in FIG. 3, and delays the inputted signal by a predetermined amount of delay time corresponding to the lengths of the springs 14 and outputs the delayed signal. The multipliers 94 and 98 are to control the amplitude characteristic of the inputted signal by a predetermined gain and to output the gain-controlled signal. The filter 97 is to control the frequency characteristic of the inputted signal and to output the frequency-controlled signal, and may be constituted by a low pass filter, for example. The output from the filter 97 is outputted as a combined signal SS, which is in turn supplied to one input of each of the adders 44, 47, 54, 57, 64 and 67 via each of multipliers 44*c*, 47*c*, 54*c*, 57*c*, 64*c* and 67*c*. The multipliers 44*c*, 47*c*, 54*c*, 57*c*, 64*c* and 67*c* are to control the amplitude characteristic of the inputted signal with each predetermined gain and to output the gain-controlled signal. In place of taking out the combined signal SS from the output point of the filter 97, the combined signal may be taken out from any other points in the loop circuit constituted by the adder 92, the delay circuit 93, the multiplier 94, the adder 95, the delay circuit 96, the filter 97 and the multiplier 98.

To the adder 95 of the combined signal supplying circuit 90 is supplied the output signal from the output terminal 87 (OUT) via a multiplier 101 and a filter 102 respectively controlling the amplitude characteristic and the frequency characteristic of the signal, to simulate the phenomenon of the acoustic signal in space vibrating the outer box 15 of the mechanical reverberation apparatus of FIG. 3, as the adder 95 in the electric circuit locates between the delay circuits 93 and 96. These multiplier 101 and filter 102 constitute an output signal supplying circuit together with the loop circuit consisting of the adder 92, the delay circuit 93, the multiplier 94, the adder 95, the delay circuit 96, the filter 97 and the multiplier 98, and supplies the output (OUT) from this signal processing circuit also to one of the input terminals of each of the adders 44, 47, 54, 57, 64 and 67 respectively of the first, second and third delay loop circuits 40, 50 and 60 each via each of multipliers 44*c*, 47*c*, 54*c*, 57*c*, 64*c* and 67*c*.

Next, a detailed description will be made with respect to the operation of the signal processing circuit as constructed above. When input signals of a digital format representing musical instrument tones, voices and the like are inputted externally from the input terminal 71, the inputted signals are controlled in its frequency characteristic by the filter 72 and in its amplitude characteristic individually by the multipliers 73–75 respectively, and are supplied to the adders 47, 57 and 67, respectively. This corresponds to the phenomenon of the electromagnetic transducers in a mechanical type reverberation apparatus of FIG. 3 driving the respective first ends of the plurality of coil springs 13.

The signal inputted to the adder 47 circulates through the delay loop signal path consisting of the allpass filters 48*a*, 48*b*, the first delay circuit 41, the multiplier 43, the adder 44, the filter 45, the second delay circuit 42 and the multiplier 46. During the circulation of the signals therethrough, the signals are subjected to the control in signal characteristics such as frequency characteristic, phase characteristic and amplitude characteristic Especially, the allpass filters 48*a* and 48*b* generate a number of signals which are different in phase from each other corresponding to the reflected waves. This signal circulation process simulates the vibrations propagating back and forth in the plurality of coil springs 13 in the above-mentioned mechanical type reverberation apparatus. Also the signals inputted to the adders 57 and 67 respectively circulate through the respective delay loop signal paths respectively consisting of the allpass filters 58*a*, 58*b* and 68*a*, 68*b*, the first delay loop circuits 51 and 61, the multipliers 53 and 63, the adders 54 and 64, the filters 55 and 65, the second delay circuits 52 and 62 and the multipliers 56 and 66, similarly to the case of the above-mentioned first delay loop circuit 40, wherein the signals are controlled in signal characteristics such as frequency characteristic, phase characteristic and amplitude characteristic to form wave signals which correspond to the reflected waves.

Thus, each of the signals respectively circulating through the first through third delay loop circuits 40, 50 and 60 is taken out (as D4, D5 or D6) at the output side of each of the first delay circuits 41, 51 and 61 on the one hand, and is controlled in its amplitude characteristic by each of the multipliers 81–83 on the other hand. The amplitude-characteristic-controlled signals are additively combined by the adder 84, and the combined signal is controlled in its frequency characteristic by the filter 85 and is led to one of the inputs of the adder 86. The adder 86 additively combines this signal supplied to the one of its input and another input signal (IN) supplied to the other of its input from the input terminal 71, and outputs the combined output signal (OUT) from the output terminal 87. This corresponds to the phenomenon of picking up the vibrations at the respective second ends of the plurality of coil springs 13 in the aforesaid mechanical reverberation apparatus and combining them before mixing with the signal which is inputted to the first ends of the coil springs 13 and outputting from the apparatus.

The above-mentioned signals circulating through the first through third delay loop circuits 40, 50 and 60 are further taken out individually as the first through third delay-looped signals D1–D3 from the second delay circuits 42, 52 and 62, and each of the delay-looped signals D1–D3 is supplied to the adders 47, 57 and 67 of the delay loop circuits 40, 50 and 60 which are other than the first through third delay loop circuits 40, 50 and 60 to which each of the second delay circuits 42, 52 and 62 belongs, after being individually controlled in amplitude characteristic by the multipliers 47*a*, 47*b*, 57*a*, 57*b*, 67*a* and 67*b*. The above-mentioned signals circulating through the first through third delay loop circuits 40, 50 and 60 are still further taken out individually also from the first delay circuits 41, 51 and 61 as the fourth through sixth delay-looped signals D4–D6, and each of the delay-looped signals D4–D6 is supplied to the adders 44, 54 and 64 of the delay loop circuits 40, 50 and 60 which are other than the first through third delay loop circuits 40, 50 and 60 to which each of the first delay circuits 41, 51 and 61 belongs, after being individually controlled in amplitude characteristic by the multipliers 44*a*, 44*b*, 54*a*, 54*b*, 64*a* and 64*b*. This simulates the phenomenon occurring in the above-described reverberation apparatus of a mechanical type wherein the vibrations propagating along each one of the plurality of coil springs 13 are also transmitted to the other ones of the coil springs 13 via the supporting plates 12*a* and 12*b*. This can electrically imitate the propagation characteristic of the vibrations between the plurality of coil springs 13 via the supporting plates 12*a* and 12*b* in the mechanical type reverberation apparatus so that the sound effects imparted by the electrical sound effect imparting apparatus of the above embodiment can be close to the sound effects realized by the aforementioned reverberation apparatus of a mechanical type.

Further, the above-mentioned signals circulating through the first through third delay loop circuits 40, 50 and 60 are taken out from the respective output sides of the second delay circuits 42, 52 and 62 as the first through third delay-looped signals D1–D3, respectively, and from the respective output sides of the first delay circuits 41, 51 and 61 as the fourth through sixth delay-looped signals D4–D6, and these delay-looped signals D1–D6 are independently controlled in their amplitude characteristic by the multipliers 91*a*–9*f* before being supplied to the adder 92 to make an additively combined signal. The combined signal is then circulates through the loop circuit constituted by the adders 92, 95, the delay circuits 93, 96, the multipliers 94, 98 and the filter 97 to be controlled in the signal characteristic such as amplitude characteristic and frequency characteristic to be finally outputted as the combined signal SS The combined signal SS is controlled in the amplitude characteristic by the multiplier 44*c*, 47*c*, 54*c*, 57*c*, 64*c* and 67*c* independently before being fed back to the adder 44, 47, 54, 57, 64 and 67 of the first through third delay loop circuits 40, 50 and 60. This simulates the propagation of the vibrations in the aforementioned reverberation apparatus of a mechanical type wherein the vibrations propagating along the plural coil springs 13 are transmitted from the coil springs 13 to the outer box 15 via the supporting plates 12*a* and 12*b*, the inner box 11 and the plural suspension springs 14, and then the vibrations so transmitted to the outer box 15 are in turn fed back from the outer box 15 to the plural coil springs 13 via the plural suspension coil springs 14, the inner box 11 and the supporting plates 12*a* and 12*b*. This can electrically imitate the propagation characteristic of the vibrations between the coil springs 13 and the outer box 15 via the suspension springs 14 in the mechanical type reverberation apparatus so that the sound effects imparted by the electrical sound effect imparting apparatus of the above embodiment can be close to the sound effects realized by the aforementioned reverberation apparatus of a mechanical type.

Further, the signal (OUT) outputted from the output terminal 87 is controlled in amplitude characteristic by the multiplier 101 and in frequency characteristic by the filter 102 before being fed to the loop circuit constituted by the adders 92, 95, the delay circuits 93, 96, the multipliers 94, 98 and the filter 97, and is then fed back to the adders 44, 47, 54, 57, 64 and 67 of the first through third delay loop circuits 40, 50 and 60 as part of the abovementioned combined signal SS. This simulates the acoustic vibrations corresponding to the emitted sounds in the abovedescribed mechanical type reverberation apparatus propagating via the outer box 15, the suspension springs 14, inner box 11 and the supporting plates 12*a* and 12*b* to the plural coil springs 13. This can electrically imitate the feed-back of the acoustic signals in the mechanical type reverberation apparatus so that the sound effects imparted by the electrical sound effect imparting apparatus of the above embodiment can be close to the sound effects realized by the aforementioned reverberation apparatus of a mechanical type.

As described above, the embodiment of the present invention can electrically realize the impartation of reverberation effects realized by means of a reverberation apparatus of a mechanical type, and consequently the sound effect imparting apparatus according to the above-mentioned embodiment can be constructed at a low manufacturing cost, in a compact size and in a easy-to-handle configuration.

While the above-described embodiment employs the simulation of the propagation characteristic of vibrations between the plural coil springs via the supporting plates 12*a* and 12*b* by means of the multipliers 44*a*, 44*b*, 47*a*, 47*b*, 54*a*, 54*b*, 57*a*, 57*b*, 64*a*, 64*b*, 67*a* and 67*b*, the simulation of the propagation characteristic of vibration between the coil springs 13 and outer box 15 by means of the combined signal supplying circuit 90 and the simulation of the feed-back of acoustic signals by means of the output signal supplying circuit including the multiplier 101 and the filter 102, any one or two of the three mentioned simulations may be employed optionally.

While the above-described embodiment employs the supply of the first through sixth delay-looped signals D1–D6 to the adders 44, 47, 54, 57, 64 and 67 via the multiplier 44*a*, 44*b*, 47*a*, 47*b*, 54*a*, 54*b*, 57*a*, 57*b*, 64*a*, 64*b*, 67*a* and 67*b* alone, filters may be employed in place of or in addition to each of the multiplier 44*a*, 44*b*, 47*a*, 47*b*, 54*a*, 54*b*, 57*a*, 57*b*, 64*a*, 64*b*, 67*a* and 67*b* to control the frequency characteristic of the signals supplied to the adders 44, 47, 54, 57, 64 and 67. Further, allpass filters may be provided at the input sides or output sides of the delay circuits 93 and 96 or of the filters 97 and 102. In such a way, the propagation of vibration via the plural suspension springs 14 in the abovementioned mechanical type reverberation apparatus can be simulated more faithfully.

Further, while the above-described embodiment is provided with three channels of the first through third delay loop circuits 40, 50 and 60, only the first and second delay loop circuits may be employed by omitting one of the three. Or, there may be provided four or more channels of delay loop circuits by adding one or more of the like delay loop circuits as the first through third delay loop circuits 40, 50 and 60.

Further, while the above-described embodiment is provided with only one combined signal supplying circuit 90, a plurality of such combined signal supplying circuit 90 may be provided in a number corresponding to the number of suspension springs 14 to simulate the propagation of vibrations through the plural suspension springs 14 in consideration of the fact that the reverberation apparatus of a mechanical type shown in FIG. 3 is provided with a plurality of suspension springs 14 so that the output signals from such plural combined signal supplying circuits 90 may be added together to make a combined signal SS to be supplied to the first through third delay loop circuits 40, 50 and 60, respectively. In such an instance, in consideration of the fact that the distances between the one end of each of the suspension springs 14 and the both ends of each coil spring 13 are different from each other, further delay circuits having different delay times corresponding to the respective distances mentioned above may be provided before or after the multipliers 91*a*–91*f*.

Further, while the above-described embodiment simulates the propagation of vibrations between the coil springs 13 and the outer box 15 via the suspension springs in the mechanical-type reverberation apparatus by the use of the combined signal supplying circuit 90, the delay times in the propagation of vibrations at the inner box 11 and the outer box 15 may also be taken into consideration when determining the delay times of the delay circuits 93 and 96 in order to simulate the propagation of vibrations at the inner box 11 itself and the outer box 15 itself more faithfully. In such a case, the characteristics of the multipliers 94 and 98 and of the filter 97 may be suitably modified. Further, the combined signal supplying circuit 90 of the above embodiment may be used only to simulate the propagation of vibrations through the suspension springs 14, and separate delay loop circuits may further be provided in addition to the above combined signal supplying circuit 90 for simulating the propagation of vibrations at the inner box 11 and the outer box 15.

Further, while the above-described embodiment realizes a sound effect imparting apparatus according to this invention by utilizing digital signal processing circuit 20 capable of constructing various sound effect circuits by variously combining various electric circuits such as delay circuits, memories and arithmetic circuits, a fixed electric circuit may be utilized with the configuration as shown in FIG. 2. The circuits may be constructed using analog circuits in place of digital circuits.

This invention may not be limited to a hardware electric apparatus, but can also be realized using a computer system and an associated program thereby configuring circuits performing the equivalent functions. Also various manners of technology prevailing in the computer field may also be available.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. A sound effect imparting apparatus comprising:

plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device, an input signal supplier which receives an external input signal externally inputted to the apparatus and supplies said external input signal to input sides of the respective first delay devices of said plurality of delay loops;

a composite output device which combines the delayed output signals from the respective first delay devices of said plurality of delay loops and outputs a combined delayed output signal;

a first delayed signal supplier which controls a signal characteristic of each of said second delayed signals outputted from each of said second delay devices independently from the other second delayed signals from other second delay devices and supplies the controlled signal to the input sides of the first delay devices of other delay loops than the delay loop to which said each of the second delay devices belongs; and a second delayed signal supplier which controls a signal characteristic of each of said first delayed signals outputted from each of said first delay devices independently from the other first delayed signals from other first delay devices and supplies the controlled signal to the input sides of the second delay devices of other delay loops than the delay loop to which said each of the first delay device belongs.

2. A sound effect imparting apparatus comprising:

a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

an input signal supplier which receives an external input signal externally inputted to the apparatus and supplies said external input signal to input sides of the respective first delay devices of said plurality of delay loops;

a composite output device which combines the delayed output signals from the respective first delay devices of said plurality of delay loops and outputs a combined delayed output signal; and a combined signal supplier which combines said first delayed signals and said second delayed signals respectively from said first delay devices and said second delay devices in said plurality of delay loops and controls a signal characteristic of the combined signal to thereafter supply the controlled signal to the input sides of the first and the second delay devices of said plurality of delay loops.

3. A sound effect imparting apparatus comprising:

a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

an input signal supplier which receives an external input signal externally inputted to the apparatus and supplies said external input signal to input sides of the respective first delay devices of said plurality of delay loops;

a composite output device which combines the delayed output signals from the respective first delay devices of said plurality of delay loops and outputs a combined delayed output signal; and an output signal supplier which controls a signal characteristic of said combined delayed output signal from said composite output device and thereafter supplies the controlled signal to the input sides of the respective first and second delay devices of said plurality of delay loops.

4. A method for imparting sound effect comprising the steps of:

providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

supplying an external input signal to input sides of the respective first delay device of said plurality of delay loops;

combining the delayed output signals from the respective first delay devices of said plurality of delay loops in an output device and outputting a combined delayed output signal;

controlling a signal characteristic of each of said second delayed signals outputted from each of said second delay devices independently from the other second delayed signals from other second delay devices;

supplying the controlled signal to the input sides of the first delay devices of only delay loop other than the delay loop to which said each of the second delay devices belongs;

controlling a signal characteristic of each of said first delayed signals outputted from each of said first delay devices independently from the other first delayed signals from other first delay devices; and supplying the controlled signal to the input sides of the second delay devices of only delay loops other than the delay loop to which said each of the first delay device belongs.

5. A method for imparting sound effect comprising the steps of:

providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

supplying an external input signal to input sides of the respective first delay devices of said plurality of delay loops;

combining the delayed output signals from the respective first delay devices of said plurality of delay loops in an output device and outputting a combined delayed output signal;

combining said first delayed signals and said second delayed signals respectively from said first delay devices and said second delay devices in said plurality of delay loops; and controlling a signal characteristic of said latter combined signal and thereafter supplying the controlled signal to the input sides of the first and the second delay devices of said plurality of delay loops.

6. A method for imparting sound effect comprising the steps of:

providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

supplying an external input signal to input sides of the respective first delay devices of said plurality of delay loops;

combining the delayed output signals from the respective first delay devices of said plurality of delay loops in a composite output device and outputting a combined delayed output signal;

controlling a signal characteristic of said combined delayed output signal from said composite output device; and supplying the controlled signal to the input sides of the respective first and second delay devices of said plurality of delay loops.

7. A machine readable medium for use in a sound effect imparting apparatus of a data processing type comprising a computer, said medium containing program instructions executable by said computer for executing:

a process of providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

a process of supplying an external input signal to input sides of the respective first delay device of said plurality of delay loops;

a process of combining the delayed output signals from the respective first delay devices of said plurality of delay loops in an output device and outputting a combined delayed output signal;

a process of controlling a signal characteristic of each of said second delayed signals outputted from each of said second delay devices independently from the other second delayed signals from other second delay devices;

a process of supplying the controlled signal to the input sides of the first delay devices of only delay loops other than the delay loop to which said each of the second delay devices belongs;

a process of controlling a signal characteristic of each of said first delayed signals outputted from each of said first delay devices independently from the other first delayed signals from other first delay devices; and a process of supplying the controlled signal to the input sides of the second delay devices of only delay loops other than the delay loop to which said each of the first delay device belongs.

8. A machine readable medium for use in a sound effect imparting apparatus of a data processing type comprising a computer, said medium containing program instructions executable by said computer for executing:

a process of providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

a process of supplying an external input signal to input sides of the respective first delay devices of said plurality of delay loops;

a process of combining the delayed output signals from the respective first delay devices of said plurality of delay loops in an output device and outputting a combined delayed output signal;

a process of combining said first delayed signals and said second delayed signals respectively from said first delay devices and said second delay devices in said plurality of delay loops; and a process of controlling a signal characteristic of said latter combined signal and thereafter supplying the controlled signal to the input sides of the first and the second delay devices of said plurality of delay loops.

9. A machine readable medium for use in a sound effect imparting apparatus of a data processing type comprising a computer, said medium containing program instructions executable by said computer for executing:

a process of providing a plurality of delay loops each including a first delay device which delays an inputted signal to output a first delayed output signal, a second delay device which is connected to said first delay device and delays said first delayed output signal to output a second delayed output signal and feeds back said second delayed signal to the input side of said first delay device;

a process of supplying an external input signal to input sides of the respective first delay devices of said plurality of delay loops;

a process of combining the delayed output signals from the respective first delay devices of said plurality of delay loops in a composite output device and outputting a combined delayed output signal;

a process of controlling a signal characteristic of said combined delayed output signal from said composite output device; and a process of supplying the controlled signal to the input sides of the respective first and second delay devices of said plurality of delay loops.

* * * * *